US008881434B2

(12) United States Patent
Date et al.

(10) Patent No.: US 8,881,434 B2
(45) Date of Patent: Nov. 11, 2014

(54) APPARATUS FOR GENERATING STEAM

(75) Inventors: Milind Vishwas Date, Singapore (SG); Mohankumar Valiyambath Krishnan, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/993,442

(22) PCT Filed: Dec. 30, 2011

(86) PCT No.: PCT/IB2011/056027

§ 371 (c)(1), (2), (4) Date: Jun. 12, 2013

(87) PCT Pub. No.: WO2012/093328

PCT Pub. Date: Jul. 12, 2012

(65) Prior Publication Data

US 2013/0269224 A1 Oct. 17, 2013

(30) Foreign Application Priority Data

Jan. 3, 2011 (EP) ..... 11150008

(51) Int. Cl.

| | |
|---|---|
| ***D06F 75/18*** | (2006.01) |
| ***F22B 37/54*** | (2006.01) |
| ***F22B 1/28*** | (2006.01) |
| ***D06F 75/16*** | (2006.01) |
| *D06F 75/10* | (2006.01) |

(52) U.S. Cl.

CPC ..... *D06F 75/16* (2013.01); *F22B 37/54* (2013.01); *F22B 1/285* (2013.01); *F22B 1/28* (2013.01)

USPC ..... 38/77.82

(58) Field of Classification Search

USPC ..... 38/74, 77.6–77, 77.8–77.82; 134/166 R, 134/166 C; 392/322–324, 396–401

See application file for complete search history.

(56) References Cited

U.S. PATENT DOCUMENTS

| | | | | |
|---|---|---|---|---|
| 1,933,138 | A | | 10/1933 | Cline |
| 2,353,425 | A | * | 7/1944 | Woodman ..... 38/77.83 |
| 2,495,397 | A | | 1/1950 | Weber |
| 4,125,953 | A | * | 11/1978 | Colombo ..... 38/77.7 |
| 4,240,217 | A | | 12/1980 | Schwob |
| 4,854,059 | A | * | 8/1989 | Ronchi ..... 38/93 |
| 4,991,545 | A | | 2/1991 | Rabe et al. |
| 5,345,704 | A | | 9/1994 | Guillot et al. |

(Continued)

FOREIGN PATENT DOCUMENTS

| | | | |
|---|---|---|---|
| DE | 10357545 | A1 | 7/2005 |
| EP | 0711862 | A1 | 5/1996 |

(Continued)

*Primary Examiner* — Ismael Izaguirre

(57) ABSTRACT

The present invention relates to an apparatus for generating steam comprising a water heating chamber in which water is heated to generate steam. The apparatus also includes a cavity having an inlet communicating with the water heating chamber so that water in the water heating chamber is received in the cavity and a sealable outlet. The cavity is configured to limit the flow of convection currents in the water received in the cavity so that scales and/or solid particles suspended in the water accumulate in the cavity. Alternatively, a guide member is disposed at the inlet to the cavity which is configured to guide scales and/or solid particles suspended in the water into the cavity.

12 Claims, 5 Drawing Sheets

(56) References Cited

U.S. PATENT DOCUMENTS

| | | | | |
|---|---|---|---|---|
| 5,398,434 | A | 3/1995 | Biancalani | |
| 5,467,424 | A | 11/1995 | Davies et al. | |
| 5,826,621 | A * | 10/1998 | Jemmott | 137/853 |
| 6,427,366 | B2 | 8/2002 | Horn et al. | |
| 6,427,637 | B1 | 8/2002 | Ineichen | |
| 7,392,607 | B2 | 7/2008 | Vialle et al. | |
| 8,337,635 | B2 * | 12/2012 | Boussemart | 134/166 C |
| 2011/0274416 | A1 * | 11/2011 | Chen | 392/396 |

FOREIGN PATENT DOCUMENTS

| | | | |
|---|---|---|---|
| EP | 1059487 | A2 | 12/2000 |
| FR | 2904683 | A1 | 2/2008 |
| GB | 1550495 | A | 8/1979 |
| GB | 2377483 | A | 1/2003 |
| JP | 2001179123 | A | 7/2001 |
| WO | 9319237 | A1 | 9/1993 |
| WO | 2007/007241 | A1 | 1/2007 |
| WO | 2008017758 | A2 | 2/2008 |

* cited by examiner

APPARATUS FOR GENERATING STEAM

FIELD OF THE INVENTION

The present invention relates to an apparatus for generating steam. Furthermore, the present invention also relates to a steam system iron comprising an apparatus for generating steam.

BACKGROUND OF THE INVENTION

A steam generating unit, such as a boiler, is well known. Such a steam generating unit is used in a steam system iron to generate pressurized steam which is applied to a fabric of a garment to remove creases from the fabric.

A steam system iron comprises a base unit in which a steam generating unit is disposed and a separate steam iron head. The steam iron head is held by a user and has a sole plate which is pressed against the fabric of a garment. A flexible hose extends between the base unit and the steam iron head, and pressurized steam generated by the steam generating unit in the base unit flows along the hose to the steam iron head. The pressurized steam is then discharged from the steam iron head through holes in the sole plate.

A conventional steam generating unit comprises a housing in which a water heating chamber is defined. Water is fed into the water heating chamber through a water inlet and a heating element is operated to heat the water in the water heating chamber. The water is heated in the water heating chamber to generate steam at a high pressure, which is then exhausted from the water heating chamber through a steam outlet into the flexible hose.

When steam is generated in the water heating chamber a residual amount of water is retained in the water heating chamber. A problem with known steam generating units is that the concentration of dissolved salts and solids in the residual water increases during prolonged use of the steam generating unit. Therefore, scales and solid particles are formed in the water when water fed into the water heating chamber is heated and converted into steam due to these dissolved solids in the water. As further water is fed into the water heating chamber and converted into steam, the amount of precipitated scales and solid particles, and the concentration of the dissolved solids in the residual water increases. This is known to result in foaming of the residual water, and may lead to water and scales being drawn through the steam outlet along with the steam to the steam iron head, resulting in scale formation and accumulation in the steam iron head and staining of the garment and sole plate. Furthermore, the high concentration of dissolved solids in the water heating chamber leads to increased corrosion of the steam system iron components, such as the water heating chamber and the heating element, as well as reduced operational efficiency and a reduced life of the steam system iron.

In an attempt to mitigate the above problems it is known to rinse the water heating chamber at regular intervals with water in an attempt to remove the residual water having a high concentration of dissolved solids, and the precipitated solids from the water heating chamber. Such a rinsing operation is performed by feeding a quantity of water into the water heating chamber through an upper opening and then manually emptying the diluted water by shaking the base unit and turning the base unit upside down so that the diluted water flows from the upper opening. However, this operation is difficult for a user to perform due to the weight and size of the base unit.

Another known approach is to feed a predetermined quantity of water into the water heating chamber to dilute the residual water and to drain this diluted water from the water heating chamber. The diluted water is drained to a storage tank for subsequent disposal by a user. Such an operation may be performed automatically by a control unit. However, a problem with this arrangement is that the precipitated scales and particles are known to prevent a drain valve from sealing properly. Therefore, a filter is generally used to prevent scales and particles flowing through the drain valve, and so these scales and particles are retained in the water heating chamber.

Therefore, a problem with the above rinsing arrangements is that the precipitated scales and particles still build up in the water heating chamber in between rinsing operations and are difficult to remove from the water heating chamber.

SUMMARY OF THE INVENTION

Therefore, it is an object of the invention to provide an apparatus for generating steam which substantially alleviates or overcomes the problems mentioned above.

According to the present invention, there is provided an apparatus for generating steam comprising a water heating chamber in which water is heated to generate steam, and a cavity having an inlet communicating with the water heating chamber so that water in the water heating chamber is received in the cavity and a sealable outlet, wherein the cavity is configured to limit the flow of convection currents in the water received in the cavity so that scales and/or solid particles suspended in the water accumulate in the cavity.

Preferably, the cavity is tubular.

In one embodiment, the cavity extends from a side wall of the water heating chamber.

The apparatus may further comprise a scraper which is removably receivable in the cavity and is configured to draw scales and/or solid particles accumulated in the cavity through an outlet to the cavity.

Advantageously, the scraper is configured to seal the outlet of the cavity when the scraper is disposed in the cavity to prevent the flow of water from the outlet.

In one embodiment, the scraper comprises a scraping member which is disposable in the cavity, the scraping member being rotatable about the longitudinal axis of the cavity to scrape along an inner surface of the cavity in a radial motion.

The scraping member may comprise a helical face, which is configured to draw scales and/or solid particles accumulated in the cavity towards the outlet of the cavity when the scraper is rotated about the longitudinal axis of the cavity.

The scraper may further comprise a flange at one end of the scraper which extends into the water heating chamber and is configured to draw scales and/or solid particles accumulated in the cavity towards the outlet of the cavity when the scraper is drawn from the cavity through the outlet.

Conveniently, the scraper is threadingly engagable with the cavity so that the elongate portion rotates in the cavity when the scraper is threadingly disengaged from the cavity.

According to another aspect of the present invention, there is provided an apparatus for generating steam comprising a water heating chamber in which water is heated to generate steam, a cavity having an inlet communicating with the water heating chamber so that water in the water heating chamber is received in the cavity and a sealable outlet, and a guide member disposed at the inlet to the cavity which is configured to guide scales and/or solid particles suspended in the water into the cavity.

Preferably, the cavity is an elongate tube.

The guide member may comprise a trough portion.

The trough portion is advantageously configured to allow an unimpeded flow of water along its length.

In a preferred embodiment, the apparatus further comprises at least one outwardly extending wing portion extending from an upper edge of the trough portion.

Preferably, opposing side walls of the trough portion diverge away from each other towards a distal end of the trough portion to the inlet.

According to another aspect of the present invention, there is provided a steam system iron comprising an apparatus for generating steam.

BRIEF DESCRIPTION OF THE DRAWINGS

Preferred embodiments of the invention will now be described, by way of example only, with reference to the accompanying drawings, in which.

DETAILED DESCRIPTION OF THE EMBODIMENTS

Figure 1:
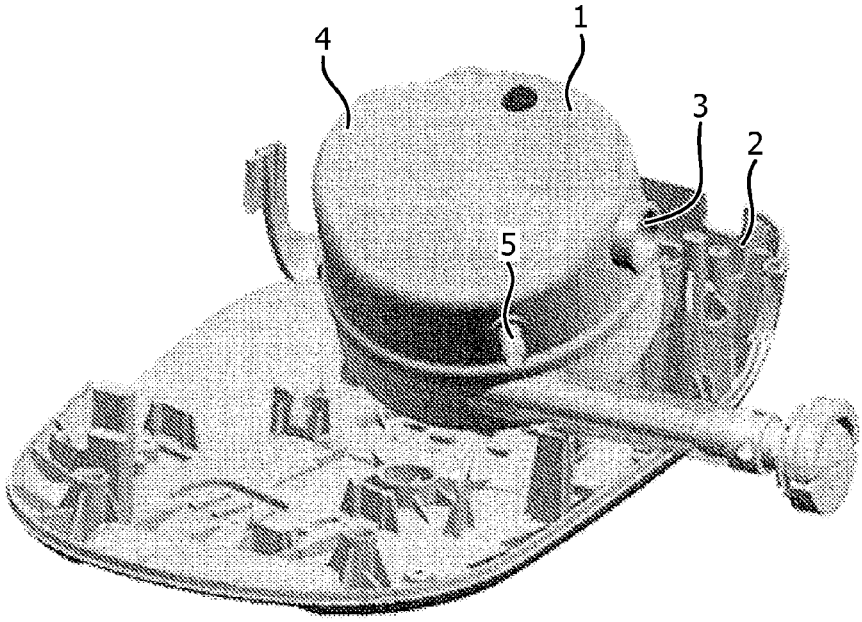
FIG. 1 shows a perspective view of an apparatus for generating steam according to a first embodiment.
Figure 2:
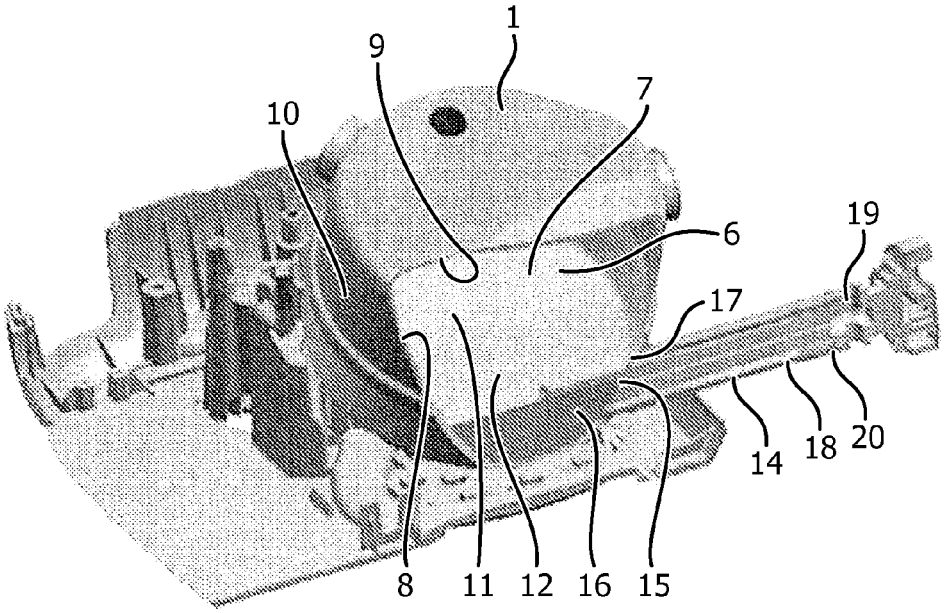
FIG. 2 shows a perspective cross-sectional view of the apparatus for generating steam shown in FIG. 1.

Referring now to FIGS. 1 to 4, an apparatus for generating steam is shown. The apparatus for generating steam in the present embodiment is a steam generating unit 1 which is disposed in a base unit 2 of a steam system iron (not shown).

The steam system iron comprises the base unit 2 and a steam iron head (not shown). The base unit 2 comprises an outer housing in which a water storage tank (not shown), the steam generating unit 1 and a control unit (not shown) is disposed. The steam iron head (not shown) comprises a sole plate with steam holes formed therein, a steam pipe to supply steam to the steam holes in the sole plate and an operating switch. The steam iron head and base unit 2 are connected by a flexible hose (not shown) to form a steam passageway between a steam outlet 3 of the steam generating unit 1 and the steam holes in the sole plate so that steam generated by the steam generating unit 1 flows through the steam outlet 3, along the steam passageway to the steam pipe and is discharged through the steam holes in the sole plate towards a fabric of a garment to remove creases from the fabric.

Although the following description relates to apparatus for generating steam used in a steam system iron, it will be appreciated that the apparatus is not limited to use with a steam system iron, and may be used in different applications, for example alternative domestic appliances such as a coffee maker, a water kettle or a steamer.

The steam generating unit 1 comprises an outer housing 4, a water inlet 5, the steam outlet 3 and an electric heating element (not shown), acting as a water heater. A water heating chamber 6 (refer to FIG. 2) is defined in the outer housing 4 and the electric heating element is disposed in the outer housing 4 to heat water fed into the water heating chamber 6 through the water inlet 5 to generate steam.

The water inlet 5 fluidly communicates with the water storage tank via a water supply pipe (not shown) to supply water into the water heating chamber 6. An electric pump (not shown), acting as a water pump, is disposed along the water supply pipe and is operated by the control unit to control the flow of water into the water heating chamber. Alternatively, it is envisaged that a one-way valve may be opened by the control unit to control the flow of water into the water heating chamber.

The steam passageway is formed by the steam outlet 3, the flexible hose and the steam pipe formed in the steam iron head. A control valve (not shown) is disposed along the steam passageway to control the flow of steam from the steam generating unit 1 and out of the steam holes in the sole plate of the steam iron head.

The water heating chamber 6 has a side wall 8, a base wall 7 at a lower end of the side wall 8 and a top wall 9 extending from an upper end 10 of the side wall 8.

A cavity 14 extends from the water heating chamber 6. The cavity 14 is tubular and has an inlet 15 to the water heating chamber 6. The inlet 15 to the cavity 14 communicates with the water heating chamber 6 and provides a fluid path between the cavity 14 and the water heating chamber 6. The inlet 15 to the cavity 14 is formed in the side wall 8 adjacent to the base wall 7, and so the cavity 14 extends from the water heating chamber 6 through the side wall 8. The longitudinal axis of the cavity 14 extends parallel to the base wall 7.

In an alternative arrangement, it is envisaged that a recess (not shown), forming part of the water heating chamber 6, is formed in the base wall 7 and a lower section of the side wall 8 extends into the recess to form a face of the recess in which the inlet to the cavity 14 is formed. The recess formed in the base wall 7 forms part of the water heating chamber 6.

The cavity 14 has a cylindrical outer wall 18. The cavity 14 defines a scale receiving space 21 which has a uniform cross-section along the length of its longitudinal axis, and has a water outlet 19 at an opposing end of the cavity 14 to the inlet 15. A screw thread 20 is formed on an inner surface 22 of the outer wall 18 adjacent to the water outlet 19.

The steam generating unit 1 is mounted to the base unit 2 and the base wall 7 of the water heating chamber 6 extends at an angle to a lower section of the base unit 2 such that the base wall 7 of the water heating chamber 6 lies at a downwardly extending incline when the base unit 2 is placed on a horizontal surface. Similarly, a longitudinal axis of the cavity 14 extends parallel to a horizontal surface on which the base unit 2 is placed, or alternatively extends downwardly relative thereto from the cavity inlet 15 to the water outlet 19.

Figure 3:
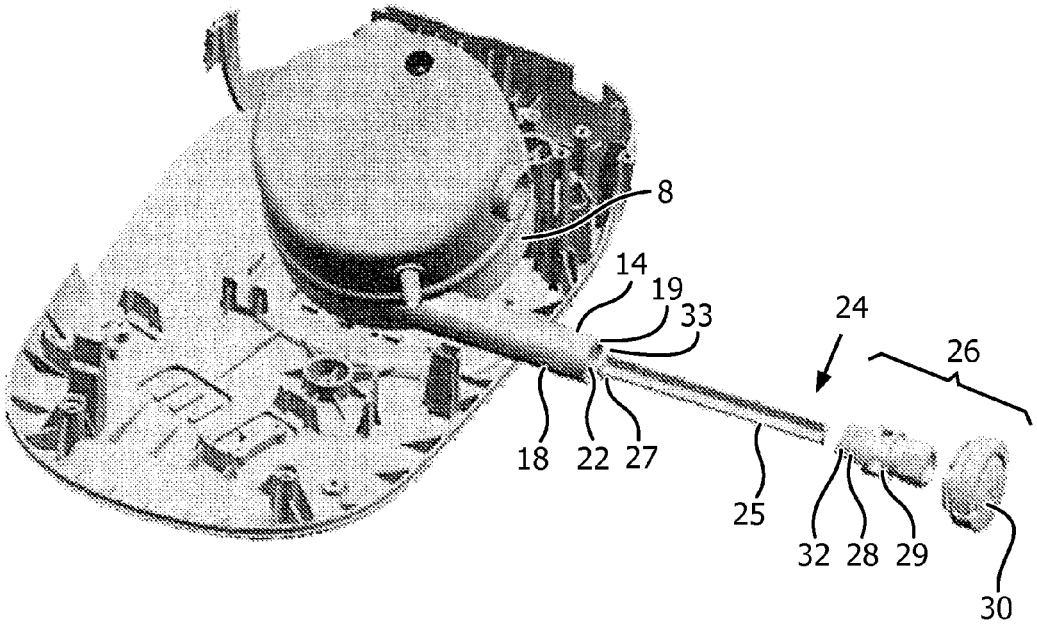
FIG. 3 shows an exploded perspective view of the apparatus for generating steam shown in FIG. 1.

The steam generating unit 1 further comprises a scraper 24 (refer to FIG. 3). The scraper 24 comprises an elongate scraping member 25 with an end cap 26 formed at one end of the scraping member 25 and an end flange 27 formed at a distal end of the scraping member 25 to the end cap 26. The end cap 26 comprises a cylindrical shoulder portion 28, an end stop 29 and a handle portion 30. The shoulder portion 28 is disposed between the end stop 29 and the scraping member 25, and has a threaded outer surface 32 which is configured to threadingly engage with the screw thread 20 formed on the inner surface 22 of the cavity outer wall 18. The handle portion 30 extends from the opposing side of the end stop 29 to the shoulder portion 28 and comprises a ring which a user is able to twist and pull to maneuver the scraper 24. The scraper 24 is formed from a non-corrosive material, such as a molded plastic.

Figure 4:
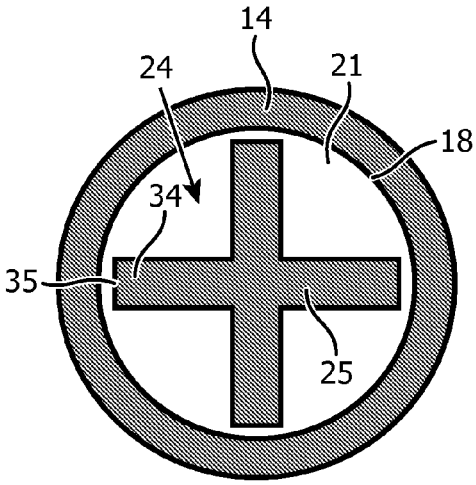
FIG. 4 shows a cross-sectional view of a cavity with a scraper of the apparatus for generating steam shown in FIG. 1.

The end flange 27 has a circular outer edge 33 which corresponds to the diameter of the inner surface 22 of the cavity 14 so that the end flange 27 slide fits in the cavity 14 and is slidable along the length of the cavity 14 along the longitudinal axis of the cavity. Referring to FIG. 4, the scraping member 25 has a cross-shaped cross-sectional profile along its longitudinal axis with four arms 34 extending perpendicular to each other of equal height. The scraping member 25 is configured to slide in the cavity 14, with an end 35 of each arm 34 lying proximate to the inner surface 22 of the cavity outer wall 18. The longitudinal axis of the scraping member 25 is aligned with a central axis of the end flange 27 and shoulder portion 28 of the end cap 26.

The scraper 24 is slidably insertable in the cavity 14. The scraping member 25 is slid into the cavity 14 until the shoulder portion 28 of the scraper 24 abuts the end of the cavity 14, and the scraper 24 is then rotated so that the threaded outer surface 32 of the shoulder portion 28 threadingly engages with the screw thread 20 of the cavity outer wall 18. The scraper 24 is rotated until the end stop 29 abuts the end of the cavity 14. The water outlet 19 is therefore fluidly sealed by the threaded engagement.

When the scraper 24 is disposed in the cavity 14 and is threadingly engaged therewith at one end, the scraping member 25 extends along the length of the cavity 14 and extends into water heating chamber 6. Therefore, the water heating chamber 6 continues to fluidly communicate with the cavity 14 when the end of the scraping member 25 extends therethrough. The end flange 27 at the end of the scraping member 25 is therefore also disposed in the water heating chamber 6 and so does not restrict access to the cavity inlet 15.

When the steam generating unit 1 is operated in its standard operating mode, the water pump is operated by the control unit to feed water into the water heating chamber 6 through the water inlet 5. The water fed into the water heating chamber 6 is heated by the water heater and is converted into steam. However, a residual amount of water does not convert into steam and pools at the lower end of the water heating chamber 6. This residual water is also received in the cavity 14. Water is prevented from flowing from the outlet of the cavity 14 by the end cap 26 of the scraper 24 threadingly engaging with the end of the cavity 14 to form a pressure tight seal.

Steam produced in the water heating chamber 6 at a high pressure flows from the water heating chamber 6 through the steam outlet 3 for use in pressing the fabric of a garment. However, during this process, precipitated scales and solid particles are formed in the water heating chamber due to dissolved salts and solids in the water. It will be appreciated that the concentration of these dissolved salts and solids in the residual water increases as further water is supplied into the water heating chamber 6 to be converted into steam. As the water in the water heating chamber 6 is heated, convection currents are formed in the water which causes the precipitated scales and solid particles suspended in the water to move within the water. The size and shape of the cavity 14 limits the flow of convection currents in the residual water received in the cavity 14 and so the scales and/or solid particles suspended in the water accumulate in the cavity 14. Therefore, the cavity 14 forms a dead zone, in which the flow of convection currents is restricted, and so scales and solid particles accumulate in the cavity 14. As further water is fed into the water heating chamber and converted into steam, additional precipitated scales and solid particles are formed which then accumulate in the cavity 14.

An advantage of this arrangement is that scales and solid particles accumulate in the cavity instead of the water heating chamber itself.

After a period of time, a user performs a rinsing process on the steam generation unit. The steam generating unit is placed in a non-operational state and the user rotates the scraper 24 by holding the handle portion 30 of the end cap 26 and rotating it to threadingly disengage the shoulder portion 28 from the end of the cavity outer wall 18. As the scraper 24 is forced to rotate due to the action of the user and the corresponding threads, the scraping member 25 rotates in the cavity 14 and the edges 35 of the scraping member arms 34 abut the accumulated scales and solid particles adhered to the inner surface 22 of the cavity 14 causing them to separate from the inner surface 22 of the cavity outer wall 18.

Once the shoulder portion 28 of the scraper 24 disengages from the thread of the cavity 14, the user then draws the scraper 24 from the cavity 14. The outer edge 33 of the end flange 27 has a diameter corresponding to the diameter of the cavity 14, so that the end flange 27 is slidable along the cavity 14 in a longitudinal direction, and so the end flange 27 scrapes the inner surface 22 of the cavity outer wall 18 and draws the scales and solid particles which have accumulated in the cavity 14 from the cavity 14. Therefore, scales and solid particles formed in the water heating chamber 6 are easily removed from the water heating chamber 6.

The inlet 15 to the cavity 14 is disposed at the lowest part of the water heating chamber 6 and so the residual water in the water heating chamber 6 flows along the cavity 14 to the water outlet 19 and out of the steam generating unit 1. Therefore, the residual water in the water heating chamber 6 is easily removed from the water heating chamber 6.

To aid the removal of the scales and solid particles, as well as to remove water high in dissolved salts and solids, the user may operate the water supply pump to supply water to the water heating chamber 6 and to rinse detritus from the water heating chamber 6 out of the water outlet 19 of the cavity 4.

Figure 5:
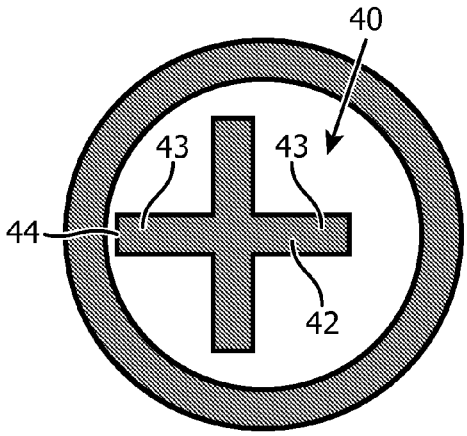
FIG. 5 shows a cross-sectional view of a cavity with another scraper of the apparatus for generating steam shown in FIG. 1.

Although the scraping member of the scraper in the above described embodiment has one cross-sectional profile, it will be appreciated that the arrangement of the scraper is not limited thereto. Another embodiment of a scraper 40 is shown in FIG. 5. In this embodiment, the arrangement of the scraper 40 is generally the same as the above described scraper and the scraping member 42 of the scraper 40 has a cross-shaped cross-sectional profile with four arms 43 extending perpendicular to each other of equal height. However, in this embodiment the longitudinal axis of the scraping member 42 extends parallel to, but offset from, a central axis of the end flange and the shoulder portion of the end cap so that, when the scraping member 42 of the scraper 40 is disposed in the cavity 14, an end 44 of one of the arms 43 of the scraping member 42 lies adjacent to the inner surface 22 of the cavity outer wall 18, and slides along the inner surface 22 in a radial direction as the scraper 24 is rotated.

Figure 6:
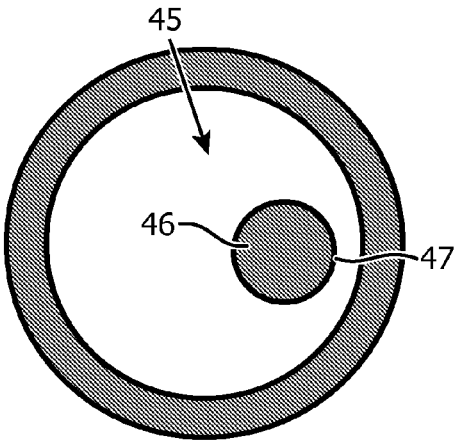
FIG. 6 shows a cross-sectional view of a cavity with another scraper of the apparatus for generating steam shown in FIG. 1.

A further embodiment of a scraper 45 is shown in FIG. 6. In this embodiment, the arrangement of the scraper 45 is generally the same as the above described scrapers 24, 40. However, in this embodiment a scraping member 46 of the scraper 45 has a circular cross-sectional profile, with a diameter smaller than the diameter of the inner surface 22 of the cavity outer wall 18. The longitudinal axis of the scraping member 46 extends parallel to, but offset from, a central axis of the end flange and the shoulder portion of the end cap so that, when the scraping member 46 of the scraper 45 is disposed in the cavity 14, an outer part of the scraping member outer surface 47 lies adjacent to the inner surface 22 of the cavity outer wall 18, and slides along the inner surface 22 in a radial direction as the scraper 24 is rotated.

Figure 7:
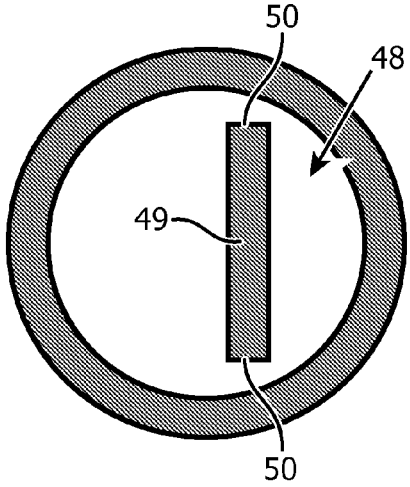
FIG. 7 shows a cross-sectional view of a cavity with another scraper of the apparatus for generating steam shown in FIG. 1.

Another embodiment of a scraper 50 is shown in FIG. 7. In this embodiment, the arrangement of the scraper 48 is generally the same as the above described scrapers 24, 40, 45. However, in this embodiment a scraping member 49 of the scraper 48 bar-shaped cross-sectional profile with opposing ends 50. The bar-shaped scraping member 49 extends parallel to, but offset from, a central axis of the end flange and the shoulder portion of the end cap so that, when the scraping member 49 of the scraper 48 is disposed in the cavity 14, the opposing ends 50 of the scraping member 49 lie adjacent to the inner surface 22 of the cavity outer wall 18, and slide along the inner surface 22 in a radial direction as the scraper 24 is rotated.

Figure 8:
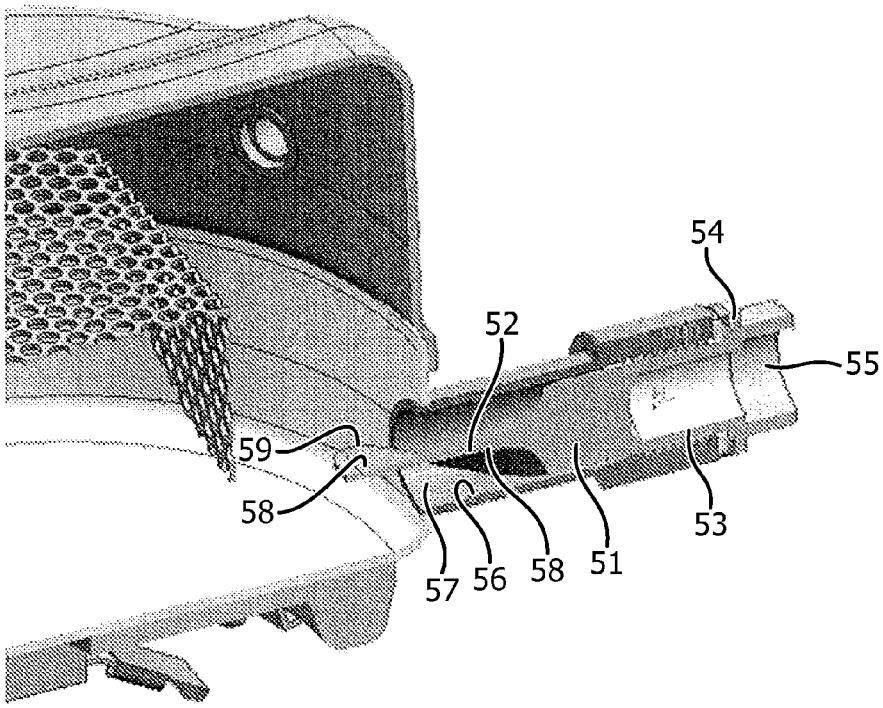
FIG. 8 shows a perspective cross-sectional view of a water heating chamber and a cavity with another scraper of the apparatus for generating steam shown in FIG. 1.

A further embodiment of an apparatus for generating steam is shown in FIG. 8. In this embodiment, the arrangement of the apparatus for generating steam is generally the same as the above described embodiments and so a detailed description will be omitted, however in this embodiment a scraper 51 has a helically shaped scraping member 52.

The scraper 51 comprises the elongate scraping member 52, a cylindrical shoulder portion 53, an end stop 54 and a handle portion 55. The shoulder portion 53 has a threaded outer surface 54 which is configured to threadingly engage with a screw thread 55 formed on the inner surface 56 of the cavity 57. The handle portion 55 enables a user to twist and pull the scraper 51, so as to manoeuvre the scraper 51.

The scraping member 52 is a helically shaped plate with opposing side faces 58 and side edges 59. The side edges 59 lie proximate to the inner surface 56 of the cavity 57 when the scraper 51 is disposed therein, so that the side edges 59 of the scraping member 52 abut accumulated scales and solid particles adhered to the inner surface 56 of the cavity 57 when the scraping member 52 is rotated in the cavity 57 causing the scales to separate from the inner surface 56.

As the scraper 51 is rotated to threadingly disengage the shoulder portion 53 from the end of the cavity 57, the helically shaped scraping member 52 acts on any accumulated scales and solid particles in the cavity 57 and urges them towards the outlet to the cavity 57. This is achieved by the helical arrangement of the scraping member 52. An advantage of this arrangement is that it reduces the need for an end flange to draw the accumulated scales and solid particles out of the cavity 57.

As the scraper 51 is drawn from the cavity 14, the residual water in the water heating chamber 6 flows along the cavity 14 to the water outlet 19, and out of the steam generating unit 1. Therefore, the residual water in the water heating chamber 6 is easily removed from the water heating chamber 6.

Figure 9:
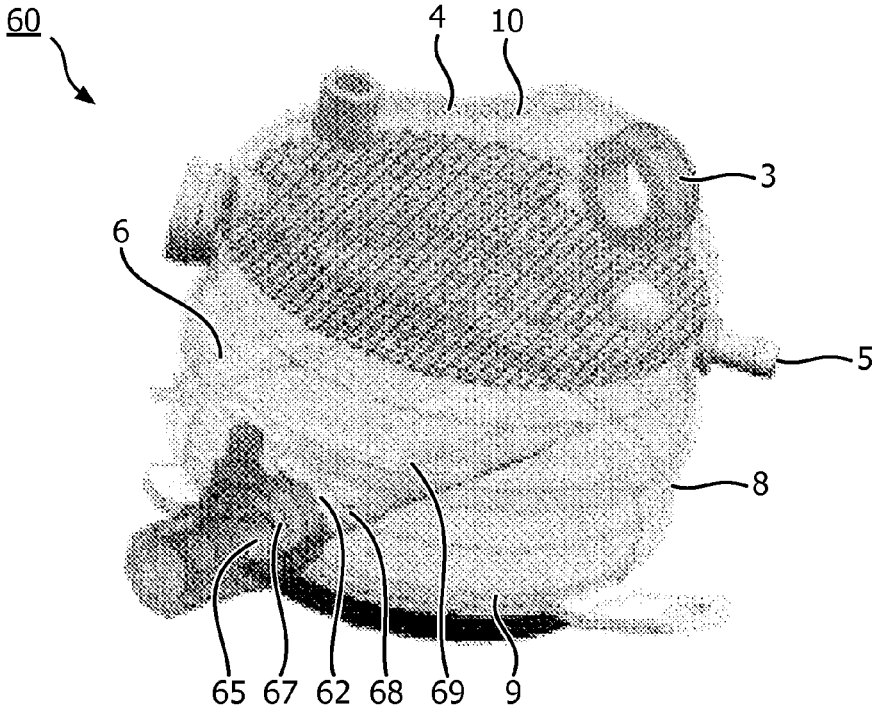
FIG. 9 shows a perspective view of an apparatus for generating steam according to a second embodiment.

Another embodiment of the apparatus for generating steam is shown in FIG. 9. This embodiment of apparatus for generating steam is generally the same as the embodiment discussed above and so a detailed description will be omitted herein. However, in this embodiment a guide member is used to guide scales and/or solid particles suspended in the water in the water heating chamber into the cavity.

Figure 10:
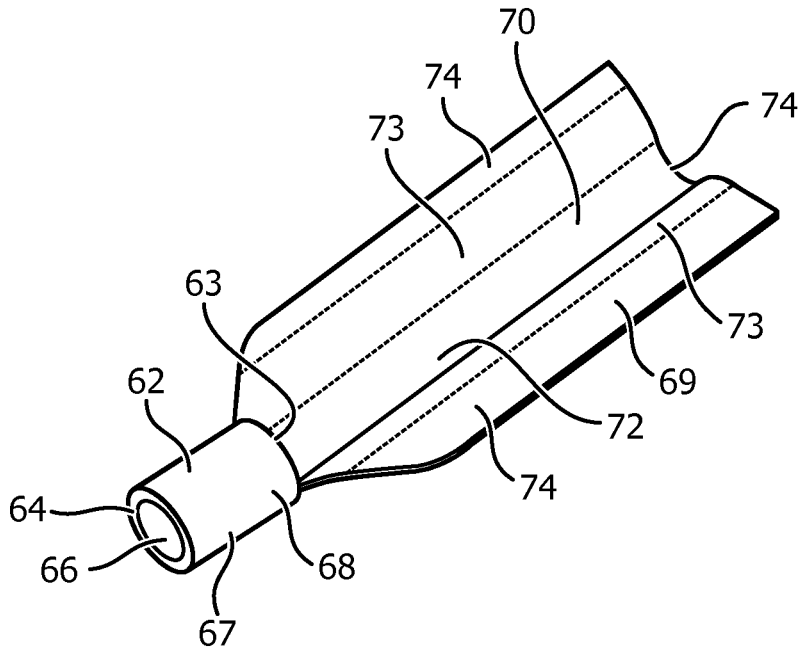
FIG. 10 shows a perspective view of a guide member of the apparatus for generating steam shown in FIG. 9.
Figure 11:
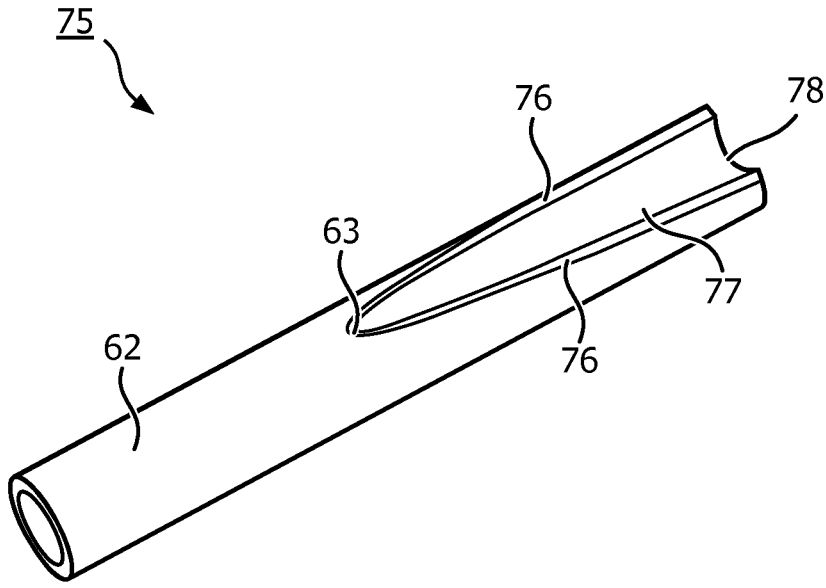
FIG. 11 shows a perspective view of an alternative guide member of the apparatus for generating steam shown in FIG. 9.

Referring now to FIGS. 9 to 11, an apparatus for generating steam is shown. The apparatus for generating steam includes a steam generating unit 60 which is disposable in a base unit of a steam system iron (not shown).

The steam generating unit 1 comprises an outer housing 4, a water inlet 5, a steam outlet 3 and an electric heating element (not shown), acting as a water heater. A water heating chamber 6 is defined in the outer housing 4 and the electric heating element is disposed in the outer housing 4 to heat water fed into the water heating chamber 6 through the water inlet 5 to generate steam.

The water heating chamber 6 has a side wall 8, a base wall 7 at a lower end of the side wall 8 and a top wall 9 extending from an upper end 10 of the side wall 8. The steam generating unit 60 further comprises a cavity 62 having an inlet 63 in fluid communication with the water heating chamber 6 so that residue water in the water heating chamber is received in the cavity 62. The cavity 62 is tubular and has an outlet 64 provided at an opposing end of the cavity 62 to the inlet 63.

A control valve 65 is disposed at the outlet 64 to the cavity 62 to seal the outlet 64 and to control the flow of water through the outlet 64. The control valve 65 in this embodiment is a ball valve. An advantage of a ball valve is that it reduces leakage issues associated with the lodging of scales and/or solid particles at a valve seal, as may happen with other types of valves, for example a plunger valve.

The cavity 62 defines a fluid path between the inlet 63 to the water heating chamber 6 and the outlet 64. The cavity 62 also defines a scale receiving space, and has an inner cylindrical surface 66.

The inlet 63 to the cavity 62 is diposed proximate to the base wall 7 of the water heating chamber 6, so that residue water in the water heating chamber 6 is received in the cavity 62, and flows through the cavity 62 from the water heating chamber 6 when the cavity outlet 64 is open.

In the present embodiment, the cavity 62 comprises a first portion 67 extending outwardly from the side wall 8 of the water heating chamber 6 and a second portion 68 extending from the first portion 67 into the water heating chamber 6. The first and second portions 67, 68 are integrally formed, although it will be appreciated that the first and second portions 67, 68 may be releasably mountable to each other to aid cleaning.

A guide member 69 extends from an end of the cavity 62. The guide member 69 is configured to guide scales and/or solid particles suspended in the water in the water heating chamber into the cavity 6.

The guide member 69 comprises a trough portion 70 which forms a channel extending from the inlet 63 to the cavity 62. The trough portion 70 has a lower face 72 with opposing upstanding side faces 73 which are arcuately joined to the lower face 72.

The guide member 69 is integrally formed with the cavity 62, and the lower and side faces 72, 73 of the guide member 69 conform to the inner surface 66 of the cavity 62 to form a smooth surface. An opposing end 74 of the guide member 69 to the inlet 63 to the cavity 62 is open. The trough portion 70 is configured to allow an unimpeded flow of water along its length.

Wing portions 74 extend outwardly from upper edges of the trough portion side faces 72, 73. The wing portions 74 act to guide scales and/or solid particles suspended in the residue water in the water heating chamber 6 into the trough portion 70.

When the steam generating unit 60 is operated in its standard operating mode, water is fed into the water heating chamber 6 is heated by the water heater and is converted into steam. However, a residual amount of water does not convert into steam and pools at the lower end of the water heating chamber 6. This residual water is also received in the cavity 62 and submerges the guide member 69. Water is prevented from flowing from the outlet of the cavity 62 by the control valve 65.

Steam produced in the water heating chamber 6 at a high pressure flows from the water heating chamber 6 through the steam outlet 3 for use in pressing the fabric of a garment. However, during this process precipitated scales and solid particles are formed in the water heating chamber due to dissolved salts and solids in the water. It will be appreciated that the concentration of these dissolved salts and solids in the residual water increases as further water is supplied into the water heating chamber 6 to be converted into steam. As the water in the water heating chamber 6 is heated convection currents are formed in the water which causes the precipitated scales and solid particles suspended in the water to move within the water. The guide member 69 is positioned in the path of the convention currents, determined by the position of the heater, so the scales and/or solid particles suspended in the water are guided by the guide member 69 towards the cavity 62. As further water is fed into the water heating chamber and converted into steam, additional precipitated scales and solid particles are formed which then are guided by the guide member 69 towards the cavity 62 and accumulate in the cavity 14.

After a period of time, a user performs a rinsing process on the steam generation unit. The steam generating unit is placed in a non-operational state and the control valve 65 is opened. Residue water in the water heating chamber 6 flows over the guide member 69, and the shape of the guide member optimizes the flow to encourage the removal of precipitated scales and solid particles along with the residual water. Therefore, the residual water in the water heating chamber 6 is easily removed from the water heating chamber 6. The tubular cavity 62 helps create a high velocity flow profile to drag precipitated scales and/or solid particles from the guide member 69 when residue water flows through the cavity 62.

To aid the removal of the scales and solid particles, as well as to remove water high in dissolved salts and solids, the user may operate the water supply pump to supply water to the water heating chamber 6 and to rinse detritus from the water heating chamber 6.

Another arrangement of a guide member 75 is shown in FIG. 11. With this arrangement opposing side walls 76 of a trough portion 77 diverge away from each other towards a distal end 78 of the trough portion 77 to the inlet 63 to the cavity 62.

Although in the above described embodiment the guide member 69 is integrally formed with the cavity 62, it will be appreciated that the cavity 62 and guide member 69 may be releasably mountable to each other to aid cleaning.

Although in the above described embodiment the cavity 62 extends into the water heating chamber 6, it will be appreciated that the inlet 63 to the cavity 62 may be formed at the side wall of the water heating chamber 6, and the guide member 69 will then extend from the side wall into the water heating chamber 6.

Although in the above described embodiment the guide member 69 is disposed in the water heating chamber 6, adjacent to the base wall 9, it will be appreciated that the guide member 69 may be integrally formed with the base wall 9.

Although different embodiments of a steam generating unit 1 have been described above, it will be appreciated that the embodiments, or aspects of each embodiment may be used in conjunction with each other in order to improve the removal of scales and solid particles from a water heating chamber of a steam generating unit.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claims in any claim and whether or not it mitigates any or all of the same technical problems as does the parent invention. The applicants hereby give notice that new claims may be formulated to such features and/or combinations of features during the prosecution of the present application or of any further application derived there from.

The invention claimed is:

1. An apparatus for generating steam comprising:

a water heating chamber in which water is heated to generate steam; and a cavity having an inlet communicating with the water heating chamber so that water in the water heating chamber is received in the cavity, and a sealable outlet, said cavity extending externally from said water heating chamber, wherein the cavity is configured to limit the flow of convection currents in the water received in the cavity so that scales and/or solid particles suspended in the water accumulate in the cavity, wherein said apparatus for generating steam further comprises:

a scraper removably receivable in the cavity and configured to draw scales and/or solid articles accumulated in the cavity through the sealable outlet of the cavity the scraper comprising an elongated scraping member disposable in the cavity the elongated scraping member being rotatable about a longitudinal axis of the cavity to scrape along an inner surface of the cavity in a radial motion.

2. The apparatus for generating steam as claimed in claim 1, wherein the cavity is tubular.

3. The apparatus for generating steam as claimed in claim 1, wherein the cavity extends from a side wall of the water heating chamber.

4. The apparatus for generating steam as claimed in claim 1, wherein the scraper is configured to seal the sealable outlet of the cavity when the scraper is disposed in the cavity to prevent the flow of water from the sealable outlet.

5. The apparatus for generating steam as claimed in claim 1, wherein the elongated scraping member comprises a helical face configured to draw scales and/or solid particles accumulated in the cavity towards the outlet of the cavity when the scraper is rotated about the longitudinal axis of the cavity.

6. The apparatus for generating steam as claimed in claim 1, wherein the scraper further comprises a flange at one end of the scraper said flange extending into the water heating chamber, said flange being configured to draw scales and/or solid particles accumulated in the cavity towards the sealable outlet of the cavity when the scraper is drawn from the cavity through the sealable outlet.

7. The apparatus for generating steam as claimed in claim 6, wherein the scraper is threadingly engagable with the cavity so that the elongated scraping member rotates in the cavity when the scraper is threadingly disengaged from the cavity.

8. An apparatus for generating steam comprising:

a water heating chamber in which water is heated to generate steam;

a cavity having an inlet communicating with the water heating chamber so that water in the water heating chamber is received in the cavity, and a sealable outlet, said cavity extending externally from said water heating chamber; and a guide member comprising a trough portion disposed at the inlet to the cavity, said trough portion being configured to guide scales and/or solid particles suspended in the water into the cavity.

9. The apparatus for generating steam as claimed in claim 7, wherein the cavity is an elongate tube.

10. The apparatus for generating steam as claimed in claim 8, wherein the trough portion is configured to allow an unimpeded flow of water along its length.

11. The apparatus for generating steam as claimed in claim 8, wherein said guide member further comprises at least one outwardly extending wing portion extending from an upper edge of the trough portion.

12. A steam system iron comprising the apparatus for generating steam as claimed in claim 1.

* * * * *